US010290198B2

(12) United States Patent
Kay

(10) Patent No.: US 10,290,198 B2
(45) Date of Patent: May 14, 2019

(54) SENSOR SYSTEM

(71) Applicant: Doro AB, Malmö (SE)

(72) Inventor: David Kay, Malmö (SE)

(73) Assignee: Doro AB, Malmö (SE)

( * ) Notice: Subject to any disclaimer, the term of this patent is extended or adjusted under 35 U.S.C. 154(b) by 0 days.

(21) Appl. No.: 16/014,897

(22) Filed: Jun. 21, 2018

(65) Prior Publication Data

US 2018/0365960 A1 Dec. 20, 2018

Related U.S. Application Data

(63) Continuation of application No. 15/698,380, filed on Sep. 7, 2017, now Pat. No. 10,032,354, which is a (Continued)

(30) Foreign Application Priority Data

Aug. 22, 2013 (EP) ..... 13181268

(51) Int. Cl.
*G08B 21/04* (2006.01)
*G08B 29/18* (2006.01)

(52) U.S. Cl.
CPC ..... *G08B 21/0492* (2013.01); *G08B 21/043* (2013.01); *G08B 21/0423* (2013.01); *G08B 29/183* (2013.01)

(58) Field of Classification Search
CPC combination set(s) only.
See application file for complete search history.

(56) References Cited

U.S. PATENT DOCUMENTS 6,002,994 A 12/1999 Lane et al.
9,830,795 B2 * 11/2017 Kay ..... G08B 21/0492
(Continued)

FOREIGN PATENT DOCUMENTS

AU 2009202482 A1 1/2010
EP 2431955 A2 3/2012
(Continued)

OTHER PUBLICATIONS

International Search Report and Written Opinion for International Application No. PCT/EP2014/067840, dated Oct. 29 (16 pages).
(Continued)

*Primary Examiner* — Travis R Hunnings
(74) *Attorney, Agent, or Firm* — Merchant & Gould P.C.

(57) ABSTRACT

A multi-sensory sensor comprises at least a first and a second sensor element, wherein the multi-sensory sensor is adapted for attachment to a movable structure in a building. The multi-sensory sensor is operatively associated with a controller that is configured to receive input from said first sensor element, wherein the input is indicative of a movement of the movable structure. The controller is further configured to receive input from the second sensor element, and indirectly identify a human behavioral action in the building based on a combination of the input from the first sensor element and the input from the second sensor element. It is further configured to determine a function to be taken based on the identified action, and cause the function to be taken to be executed. In one embodiment the first sensor is a movement sensor element for sensing a movement and the second sensor element is an audio sensor element for sensing audio.

13 Claims, 10 Drawing Sheets

Related U.S. Application Data continuation of application No. 14/913,247, filed as application No. PCT/EP2014/067840 on Aug. 21, 2014, now Pat. No. 9,830,795.

(56) References Cited

U.S. PATENT DOCUMENTS

| | | | | |
|---|---|---|---|---|
| 2003/0229471 | A1* | 12/2003 | Guralnik | G06K 9/00496 702/182 |
| 2005/0137465 | A1* | 6/2005 | Cuddihy | A61B 5/1113 600/300 |
| 2006/0033625 | A1 | 2/2006 | Johnson et al. | |
| 2007/0279214 | A1* | 12/2007 | Buehler | G08B 13/19615 340/521 |
| 2009/0184821 | A1 | 7/2009 | Kuris et al. | |
| 2009/0224925 | A1* | 9/2009 | Gannot | A61B 5/1117 340/573.1 |
| 2009/0315719 | A1 | 12/2009 | Song et al. | |

FOREIGN PATENT DOCUMENTS

| | | | | |
|---|---|---|---|---|
| EP | 2515282 | A1 * | 10/2012 | G08B 5/36 |
| EP | 2515282 | A1 | 10/2012 | |

OTHER PUBLICATIONS

International Preliminary Report on Patentability for International Application No. PCT/EP2014/067840, dated Nov. 30, 2015 (22 pages).

European Search Report for EP 13181268.7 dated Feb. 6, 2014 (6 pages).

Communication for European Patent Application No. 13181268.7, dated Sep. 28, 2017 but sent by facsimile on Sep. 21, 2017.

* cited by examiner

| 110 Sensor ID | | Timing | Activity pattern |
|---|---|---|---|
| 330 First sensor element | 335 Second sensor element | | |
| a | - | - | 1 |
| - | b | - | 2 |
| c | d | - | 3 |
| e | - | Absolute time range | 4 |
| f | g | Absolute time range | 5 |
| h | - | Relative time range | 6 |
| i | j | Relative time range | 7 |
| . | . | . | . |
| . | . | . | . |
| . | . | . | . |
| m | - | - | p |

Fig 6

| 124 Activity pattern | 126 Function |
|---|---|
| 1 | 1 |
| 2 | 1, 2 |
| 3 | 3 |
| 4 | 3 |
| . . . | |
| p | q |

Fig 7

A method of configuring a multi-sensory sensor for behavioural monitoring of a user in a building:

A method of behavioural monitoring of a user in a building:

SENSOR SYSTEM

This is a Continuation Application of U.S. patent application Ser. No. 15/698,380, filed 7 Sep. 2017, which is a Continuation Application of U.S. patent application Ser. No. 14/913,247, filed 19 Feb. 2016, which is a National Stage Application of PCT/EP2014/067840, filed 21 Aug. 2014, which claims benefit of European Patent Application No. 13181268.7, filed 22 Aug. 2013, and which applications are incorporated herein by reference. To the extent appropriate, a claim of priority is made to each of the above disclosed applications.

TECHNICAL FIELD

This application relates to a sensor and a system and associated methods for behavioural monitoring.

BACKGROUND

In today's society there exist many different monitoring systems which based on an array of different sensors identify an appropriate function to execute based on the received sensor signals.

Monitor systems are becoming increasingly popular for monitoring areas of special interest. Such systems may be surveillance systems or monitoring of a care taker.

When installing a sensor system either in an indoor or an outdoor environment there are many different actions that may need to be monitored. Especially so for monitoring of a care taker. This has required the use of many specialized sensors adapted to detect a specific action. Examples may be motion sensor (IR detectors for example) for detecting movement of a person, door and window sensors (for example magnetic switches) for detecting the opening or closing of a door or window, fall sensors (such as accelerometers) for detecting if a person falls, audio sensors for detecting different sounds and heat sensors for detecting an increase in temperature indicating the presence of a human.

For instance, the U.S. Pat. No. 6,002,994 discloses a system where a plurality of different types of sensors is used. Examples are motion sensors, magnetic sensors, infrared sensors to name a few.

This system suffers from that the different sensors need to be mounted or installed in different manners depending on the sensor type. They may also require an accurate and possibly complicated installation to make sure they are properly aligned. They are thus not suitable to be installed by a layperson, and professional installation increases the price of the system often making such a system unavailable to a broader public.

The US patent application US2005/0137465 discloses a similar system and suffers from the same drawbacks.

There is thus a need for a system that is easy to install, simple to set up while still being flexible and which uses as few a number of sensors as possible. Also, there is a need for a sensor system in which the number of different types of sensors used is minimal.

SUMMARY

It is an object of the teachings of this application to overcome the problems listed above by providing a multi-sensory sensor comprising at least a first and a second sensor element, said multi-sensory sensor being adapted for attachment to a movable structure in a building, said multi-sensory sensor being operatively associated with a controller being configured to receive input from said first sensor element, said input being indicative of a movement of said movable structure, receive input from said second sensor element, indirectly identify a human behavioural action in said building based on a combination of said input from said first sensor element and said input from said second sensor element, determine a function to be taken based on the identified action and cause said function to be taken to be executed. In one embodiment said first sensor element is a movement sensor element for sensing a movement and said second sensor element is an audio sensor element for sensing audio.

Such a multi-sensory sensor is a sensor configured to sense more than one environmental condition simultaneously providing one sensory input for each environmental condition. A system as disclosed herein comprising such multi-sensory sensors can be used to indirectly sense other activities through a combination of the sensory inputs.

By insightfully analyzing different actions some related actions may be inventively identified and combined to enable indirect detection of the action.

In one embodiment the environmental conditions are audio and movement. Other environmental conditions are motion, temperature, light, position, moisture or humidity, pressure to name a few examples.

Furthermore, by enabling a sensor to detect two different sub-actions, the sensor may be able to detect multiple actions—especially if the two (or more) sub-actions are related.

It is also an object of the teachings of this application to overcome the problems listed above by providing a system comprising a multi-sensory sensor such as above.

The inventors of the present invention have realized, after inventive and insightful reasoning, that by identifying two actions related to an action to be detected and arranging sensor means to detect the two related actions, a flexible sensor system is provided. In one embodiment the action to be detected is related to a sound and a movement. Movement and sound sensors are commonly available and may also be readily combined into one sensor means as one sensor would not disturb the other sensor.

A movement is differentiated from a motion such that a movement is a general movement of the body that a sensor is placed upon or adjacent to, such as a door being opened, where as a motion is any motion detected in front of a sensor, such as a person walking through a room in front of the sensor.

By arranging a sensor to detect an action indirectly the same type of sensor may be utilized to detect different actions.

The number of sensors needed may thus be reduced, which simplifies the installation and reduces the cost of a system as fewer kinds of sensors need be installed and stocked and also a fewer number of sensors need be bought and installed.

Contrary to the prior art where a special sensor is dedicated to detecting a specific action, the sensing system according to herein utilize one and the same type of sensor for detecting all sorts of actions thereby reducing the complexity of the installation, the cost of the system (as only one type of sensor need to be manufactured and stocked) and the maintenance and repair of the system as an easily installed sensor is also easily replaced. The system is also highly flexible as one and the same kit can be used for many different purposes depending simply on the placement of the sensor(s).

It should be noted that a system according to the teachings herein may be combined with a prior art system, possibly sharing a same system server. In such a system there may be a plurality of first sensors of a multi-sensory type, and at least one second sensor of a single-sensory type. Such a system at least partially benefits from the advantages of a system according to this invention.

It is a further object of the teachings of this application to provide a method of configuring a sensor for behavioural monitoring of a user in a building, wherein the method involves providing a multi-sensory sensor having a first sensor element in the form of a movement sensor element and a second sensor element in the form of an audio sensor element, wherein the multi-sensory sensor is operatively associated with a controller. The method further involves attaching the multi-sensory sensor to a movable structure in said building and configuring said first sensor element to detect a basic movement and said second sensor element to sense audio, said basic movement and audio being indicative of a human behavioural action in said building. The method further involves configuring the controller to indirectly identify a human behavioural action based on a combination of detection signals from the multi-sensory sensor, and defining an appropriate executable function based on the identified action, wherein the function pertains to assistance, attendance, care taking, medical care, emergency service or rescue of a human user in said building.

It is a further object of the teachings of this application to provide a method of monitoring of a user in a building. The method involves providing one or more multi-sensory sensors having been configured according to the above. The method further involves receiving detection signals from said one or more multi-sensory sensors. The method further involves indirectly identifying a human behavioural action based on a combination of said detection signals, and executing the determined appropriate function.

Other features and advantages of the disclosed embodiments will appear from the following detailed disclosure, from the attached dependent claims as well as from the drawings.

Generally, all terms used in the claims are to be interpreted according to their ordinary meaning in the technical field, unless explicitly defined otherwise herein. All references to "a/an/the [element, device, component, means, step, etc]" are to be interpreted openly as referring to at least one instance of the element, device, component, means, step, etc., unless explicitly stated otherwise. The steps of any method disclosed herein do not have to be performed in the exact order disclosed, unless explicitly stated.

BRIEF DESCRIPTION OF DRAWINGS

The invention will be described in further detail under reference to the accompanying drawings in which:

FIG. 6 shows a data structure which may be used in a sensor system according to one embodiment;

FIG. 7 shows a data structure which may be used in a sensor system according to one embodiment;

DETAILED DESCRIPTION

The disclosed embodiments will now be described more fully hereinafter with reference to the accompanying drawings, in which certain embodiments of the invention are shown. This invention may, however, be embodied in many different forms and should not be construed as limited to the embodiments set forth herein; rather, these embodiments are provided by way of example so that this disclosure will be thorough and complete, and will fully convey the scope of the invention to those skilled in the art. Like numbers refer to like elements throughout.

Figure 1:
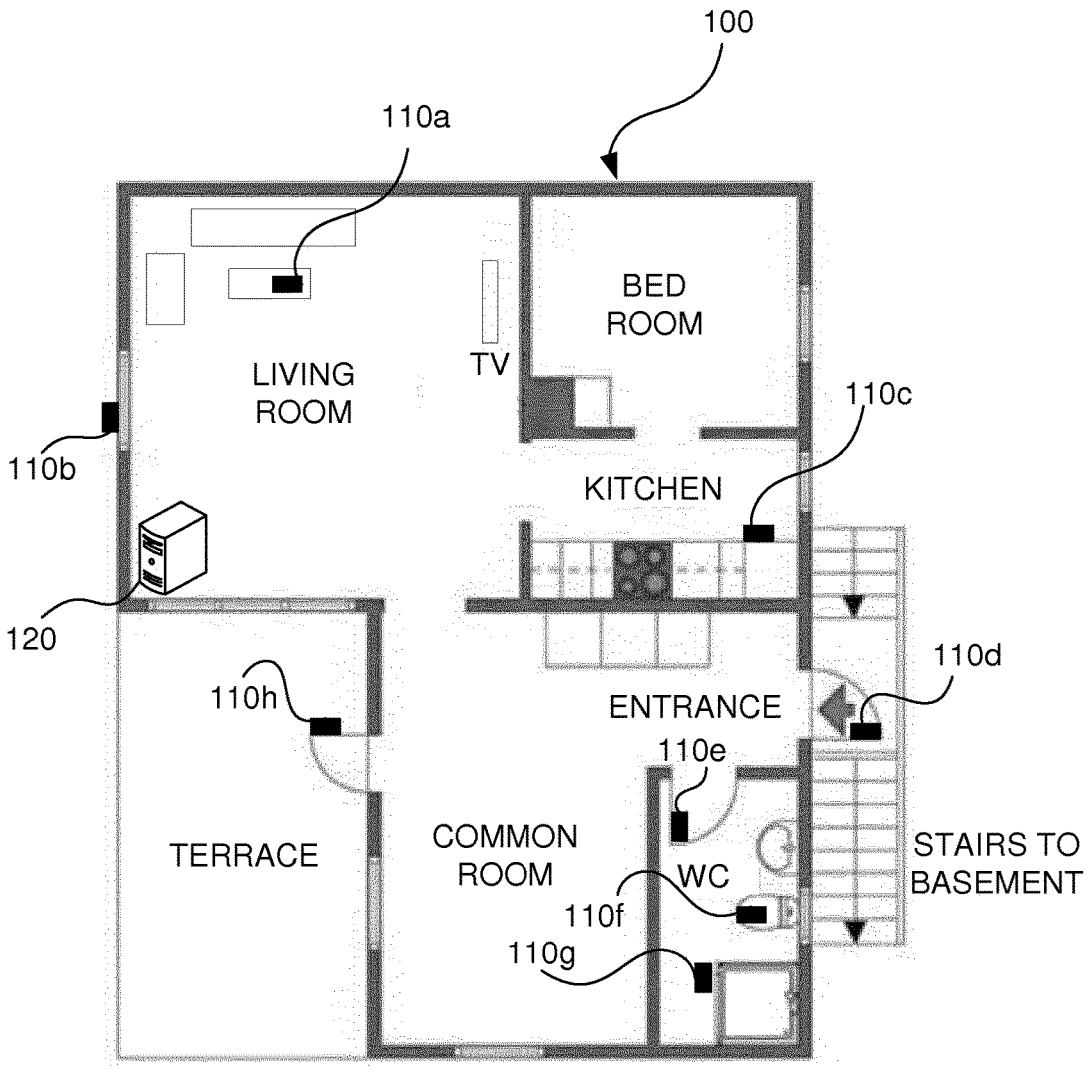
FIG. 1 shows a schematic view of a building arranged with a sensor system according to one embodiment.

FIG. 1 shows an example of a building 100, in this example a house, which is arranged with a sensor system (referenced 200 in FIG. 8) according to an embodiment.

The house has different rooms, such as a kitchen, a bed room, a bathroom (referenced WC in FIG. 1). The house is also arranged with a set of stairs leading down to a basement. The description of this application will be focussed on a few rooms, but it should be noted that the same or similar functions of the sensor system may be applied also to the other rooms (and also further other rooms in other types of houses, apartments, store rooms, etc).

The sensor system is comprised of a system server 120 and a number of multi-sensory sensors 110*a-h*. In the example of FIG. 1 there are 8 multi-sensory sensors 110*a-h*, but the number of sensors used depends on the house structure and the wanted functionality as a skilled person would realize.

The multi-sensory sensors 110 (described in detail with reference to FIG. 9) are of a multi-sensory type. The multi-sensory sensors 110 are movement and audio combined sensors 110. The movement sensor elements are accelerometer-based movement sensor elements, which has the benefit that they are easy to install. The installation requires no alignment of different components (such as magnets or light emitters, reflectors) and can easily be made by a layman. A multi-sensory sensor 110 may simply be attached to a movable structure 112, such as a door, a window, a lever (or similar) or an object. The appropriate attachment depends on the structure that the multi-sensory sensor 110 is to be attached to. For example, attaching the multi-sensory sensor 110 to a door may be accomplished using screws, nails, adhesives or simply taping the multi-sensory sensor 110 to the door, while attaching the multi-sensory sensor 110 to a remote control or a pill organiser may be accomplished using adhesives or simply taping.

Figure 9:
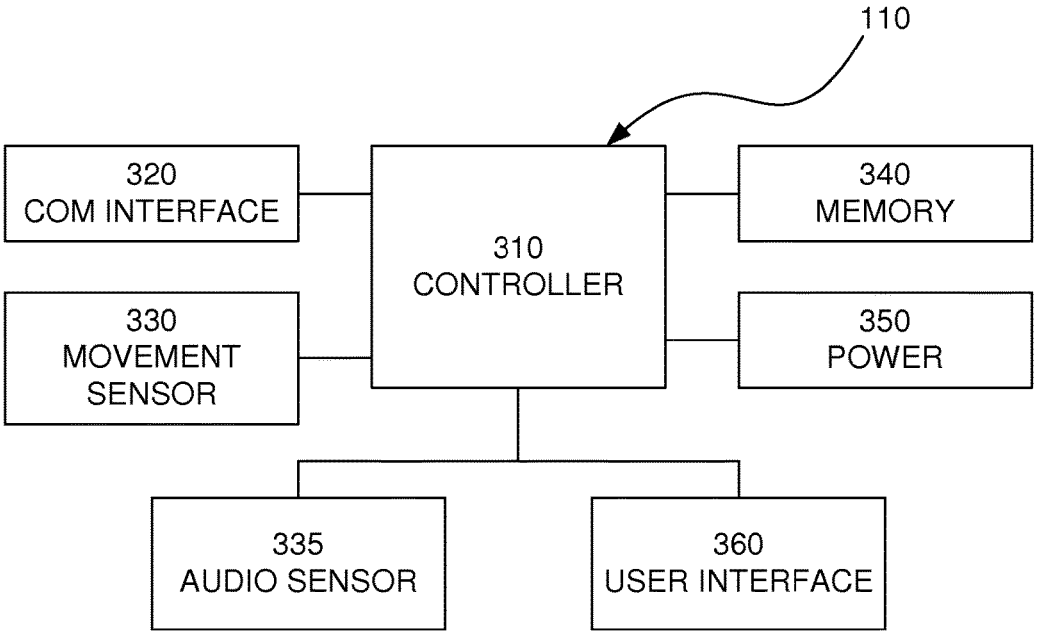
FIG. 9 shows a schematic view of a sensor according to one embodiment

The audio sensor element (reference 335 in FIG. 9) of the multi-sensory sensor 110 may be arranged to record a sound 113 and store that sound as a template to be compared with in an internal memory, referenced 340 in FIG. 9. Alternatively, the sound template to be compared with may be downloaded. Alternatively and/or additionally, the sound template to be compared with may be stored externally in the server 120, wherein the sensor will forward any sensed audio 113 to the server 120 for analysis and/or comparison.

Figure 3:
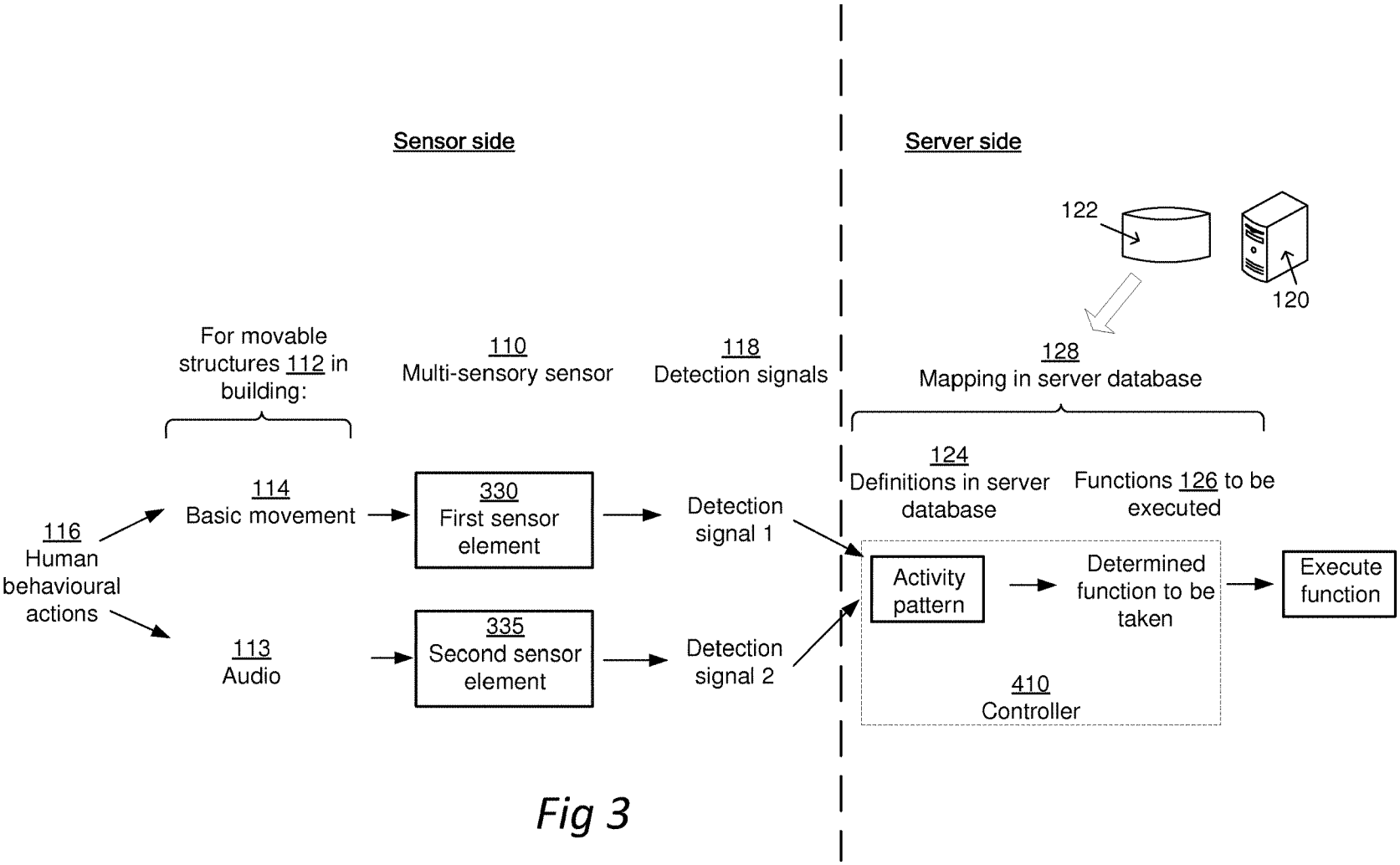
FIG. 3 shows a schematic view of the general structure of a sensor system according to one embodiment.
Figure 4:
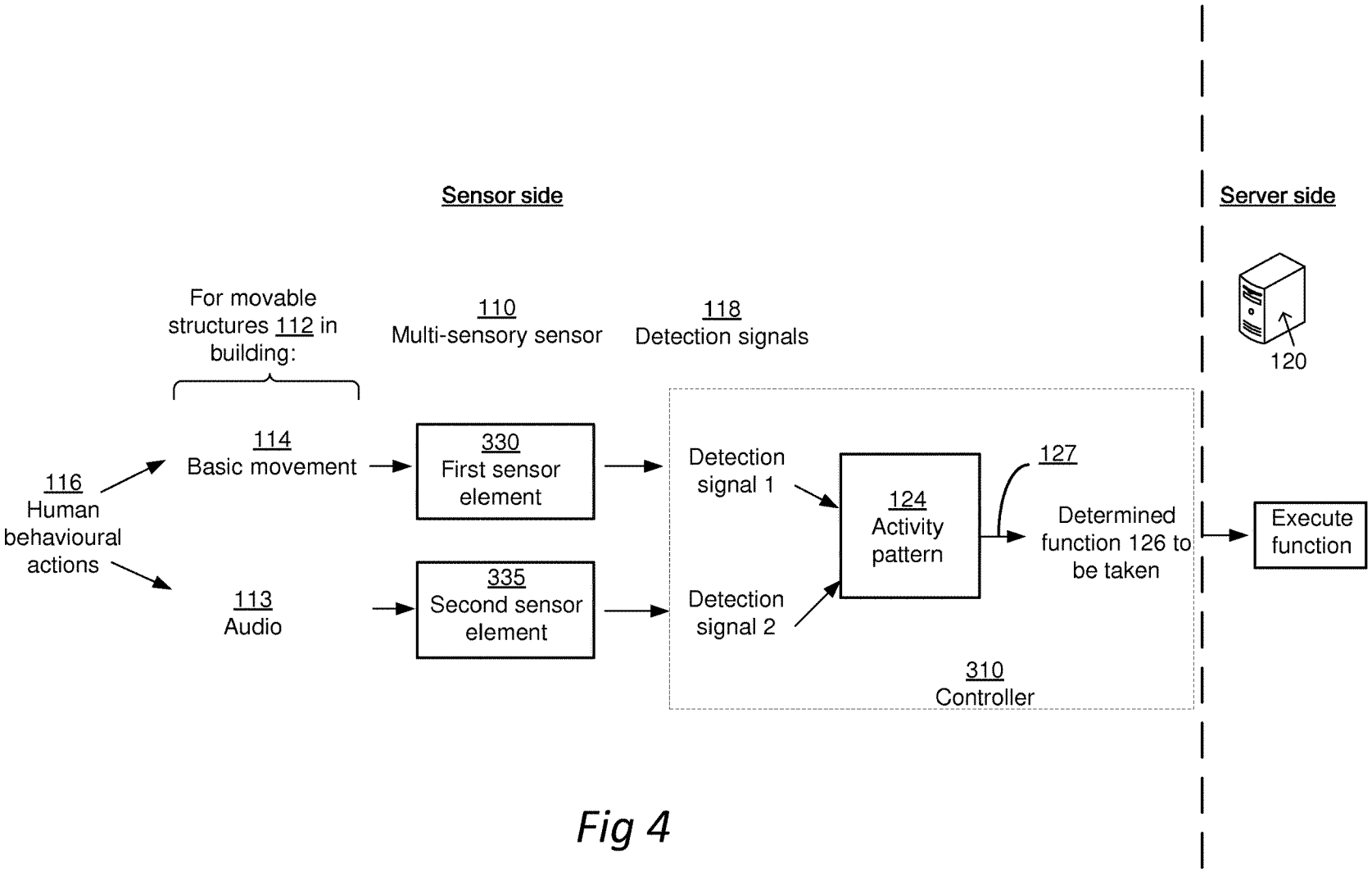
FIG. 4 shows a schematic view of the general structure of a sensor system according to another embodiment.
Figure 10:
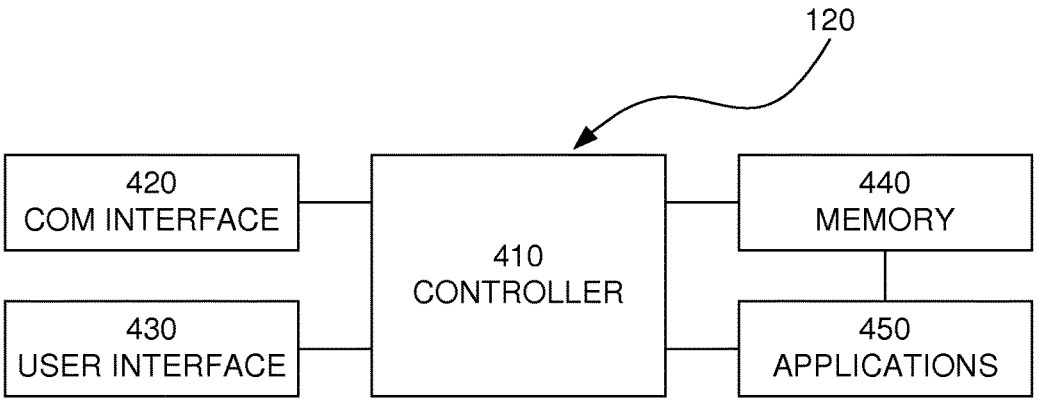
FIG. 10 shows a schematic view of a system server according to one embodiment.

A controller, either an internal controller referenced 310 in FIG. 9 and FIG. 4 or an external controller, possibly in the server 120, referenced 410 in FIG. 10 and FIG. 3, is configured to compare a received sensed audio 113 to the sound template and determine whether there is a match or not of the sensed audio 113 and the sound template. Such comparisons may be performed in a number of ways, one being by comparing a frequency spectrum of the received sensed audio 113 and the sound template. Alternatively or additionally the controller may be configured to analyze the sensed audio 113 to determine whether it matches a general sound to be detected, as represented by the sound template.

Figure 2:
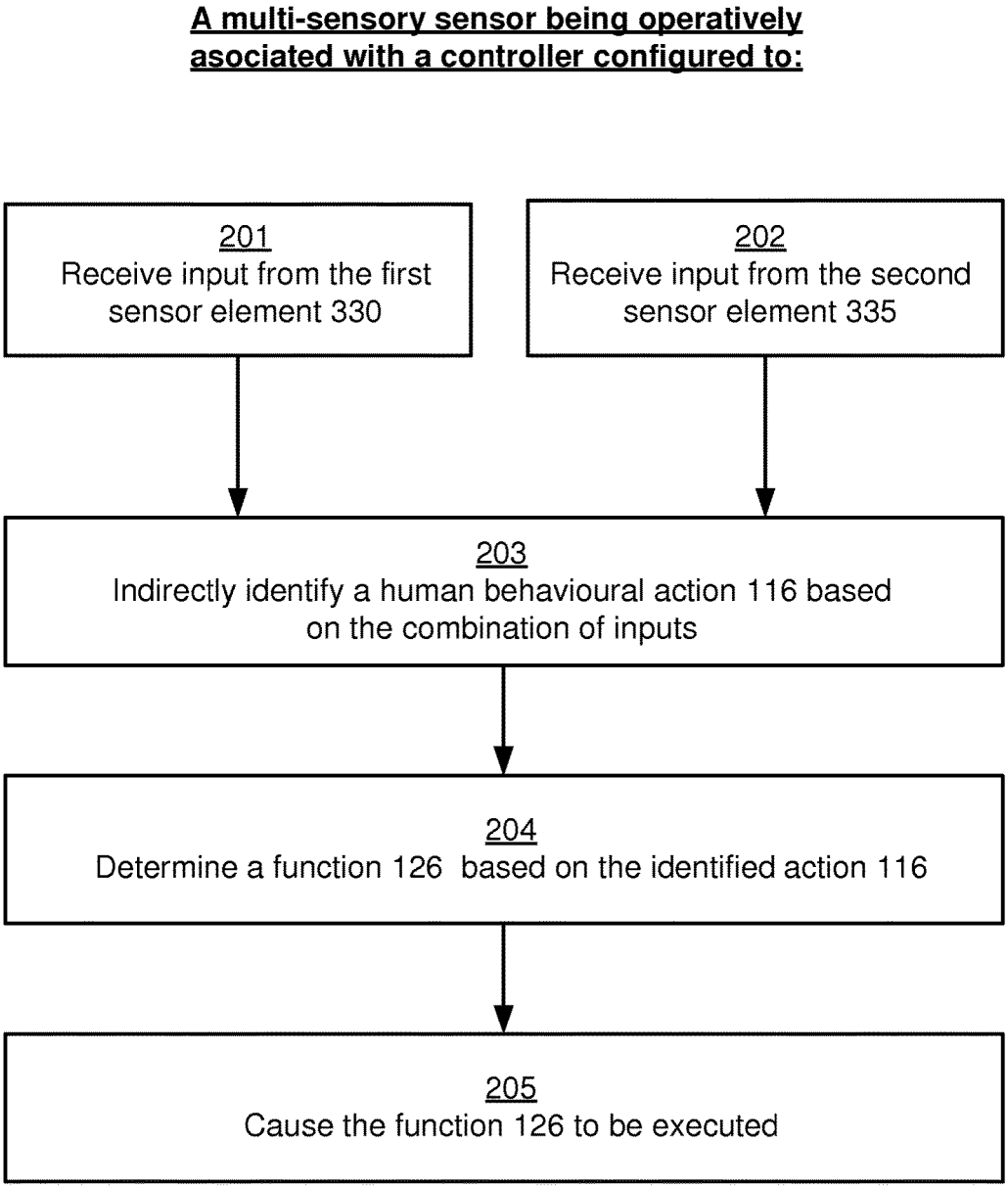
FIG. 2 shows a flowchart of a sensor functionality according to one embodiment.

Reference is now made particularly to FIG. 2 which describes the functionality steps 201-205 that the multi-sensory sensor's controller is configured to perform. One particular beneficial feature of this invention lies in the realisation that an elegantly simple solution is provided by detecting a human behavioural action 116 indirectly. An action 116 is analysed to find a basic movement 114 and an audio 113 associated with the action 116. The action 116 may not normally be considered to be associated with a movement 114 and an audio 113, but most actions 116 are at least indirectly associated with a movement 114 and an audio 113. Some examples are given below.

Making a successful toilet visit (the action) is associated with a flushing of the toilet which is associated with the movement of pulling a flushing lever or handle or opening of a bathroom door. Hence, the action of a successful toilet visit is associated with a movement of the flush lever or bathroom door combined with the audio of flushing sound. However, there are many more actions that can be done in a bathroom that may need to be monitored and each would then normally require a single purpose sensor to be used and installed. By combining sensor inputs it becomes possible to use one multi-sensory sensor to detect more than one action. For example, by placing a sensor on the bathroom door it is possible to detect that a user enters (or leaves) the bathroom. To differentiate any actions being performed in the bathroom the audio sensor element is used to provide sensed audio 113.

For example, the audio sensor element 335 may be arranged to provide sensed audio 113 to a controller which analyzes or compares the provided sensed audio 113 to different sound templates for identifying the corresponding action 116. For example, a flushing toilet sounds different from a shower, and they both sound different to the running water used when washing or brushing teeth in the sink. In this manner one sensor may be used to effectively detect three different actions 116.

In one embodiment the audio sensor element 335 is activated as the movement sensor element 330 detects movement. This saves both power and computing power as well as memory space and bandwidth as the audio sensor element is only active when needed.

The use of a passive detector to initiate an active detector thus has the benefit that the power required by the sensor is reduced. This could be of major importance in localities where there is no connection to a steady power supply.

Also, by combining the sensor inputs many different sounds that are detected (or could have been if the audio sensor element had been active) can be ignored. For example, simply the sound of running water does not indicate that a user is showering. Many other different actions 116 may be associated with the same sound, for example doing the dishes, watering flowerbeds, etc. It is the combination of the movement of opening the bathroom door and then detecting the running water that identifies a shower action. In this specific example, it may be argued that it is simply the locality of the audio sensor element that identifies the action, not the associated movement, but this is only so in this example and the detected sensor inputs are also dependent on the architecture and design of the environment in which the sensor is used. Other examples where the action can not necessarily be identified solely on the locality is for compact living situations where a hand sink (standalone or in a bathroom) may be located in close vicinity to a kitchen and it then becomes difficult to differentiate hand sink actions from kitchen sink actions. The movement sensor element 330 detecting that the bathroom door has been opened recently facilitates differentiating between the kitchen sink and the hand sink. For a standalone hand sink, the movement (or lack of) of a kitchen cabinet door may facilitate differentiating between hand sink and kitchen sink actions.

Making sure (or at least ensuring at a high likelihood) that someone is eating (the action) is associated with fetching food which is associated with opening a cabinet or refrigerator door (the movement) combined with the sound of cutlery making contact with chinaware or crockery.

Making sure (or at least ensuring at a high likelihood) that someone is taking their medication (the action) is associated with getting medication pills from a pill organiser which is associated with moving the pill organiser (the movement) in combination with running water (for filling a glass of water to aid swallowing the pills to be taken).

To enable the association between a multi-sensory sensor 110 and an appropriate function 126 to execute if a human behavioural action 116 occurs, the multi-sensory sensor 110 is configured to identify the human behavioural action 116 and determine an appropriate function to be executed. This is stored in a record or register. In one embodiment, the register may be stored in a memory (referenced 440 in FIG. 10) of the system server 120. As the human behavioural action 116 is identified, the corresponding appropriate function 126 is executed.

In another embodiment, the internal controller 310 of the multi-sensory sensor 110 is configured to store the appropriate function 126 to be executed. This is seen in FIG. 4. This requires a more complicated sensor construction, but reduces the requirements on the system server 120. In such an embodiment, as the controller 310 has identified or detected the action 116 based on a combination of the inputs from the sensor elements 330 and 335 and determined the appropriate function 126, the controller transmits an action detection signal 127 to the system server 120 which then executes the function 126 to be taken. The action detection signal 127 thus identifies the function 126 to the system server 120.

Now reference is made to FIG. 3. In one embodiment the server 120 is configured to determine the function 126 to be taken based on sensor inputs received from the multi-sensory sensors 110. In one embodiment the multi-sensory sensor 110 may be configured to transmit the sensor inputs, i.e. the detection signals 118, to the server 120 which then identifies the action 116 based on the sensor inputs.

In one embodiment the multi-sensory sensor 110 is configured to transmit a detection signal 118 from the second sensor element 335 as the first sensor element 330 has been activated. For example, as a movement sensor element 330 is activated, the multi-sensory sensor 110 activates an audio sensor element 335 and transmits any audio recorded or sensed to the controller of the server 120 for further analysis.

In one additional embodiment the multi-sensory sensor 110 also transmits the detection signal 118 from the first sensor element 330 to the controller for further (possibly combined) analysis.

As a multi-sensory sensor 110 is introduced or added to the sensor system, such as when installing the sensor system, which will be described more in reference to FIG. 11, an identifier for the sensor is registered in the record or register 122, 124, 128 along with an associated function 126 that should be taken. The identifier may be provided by the multi-sensory sensor 110 to the system server 120 or it may be assigned by the system server 120 to the multi-sensory sensor 110.

A human behavioural action 116 is thus associated with both a basic movement 114 of a movable structure 112 and an audio 113. A multi-sensory sensor 110 detects the basic movement 114 and the audio 113, and therefore indirectly the human behavioural action 116. The multi-sensory sensor 110 generates two detection signals 118 which are also associated with a function 126 through an association referred to as activity pattern 124. The appropriate function 126 to execute may depend on the room in which the multi-sensory sensor 110 is arranged, and the movable structure 112 (such as door entrance, refrigerator door, balcony door, window, remote control, a lever, a pill organiser, a drawer and a hatch) to which it is attached. The system server 120 may be arranged with a list (at least partially pre-stored or at least partially fetched from a remote service provider) of possible functions that a multi-sensory sensor 110 can be associated with. The exact functionality of such a function 126 depends on the system implementation and an extensive or complete list of possible functions would be too exhausting to be practical in a patent application. However, some examples are given of the basic functionality of appropriate functions 126 for associated human behavioural actions 116.

Multi-sensory sensor 110*a* arranged on a remote control combined with a change in surrounding audio environment—indicates an active inhabitant. Function, issue alarm if inhabitant is inactive for a period of time.

Multi-sensory sensor 110*b* arranged on window in living room combined with sharp noises—indicates a break-in or an accident. Issue alarm/notify security.

Multi-sensory sensor 110*c* arranged on refrigerator door combined with kitchen sink sounds or sounds associated with chopping or cooking (pots being placed on a stove)—indicates eating pattern/habit. Monitor correct eating habits.

Multi-sensory sensor 110*d* arranged on entrance door combined with audio detection of either greeting phrases/speech or general sounds of person moving and muffled versions of the same (for outdoor sounds)—indicates leaving/entering the building or possible break in if at awkward time.

Multi-sensory sensor 110*e* arranged on toilet door combined with sounds as discussed above—indicates possible toilet visit or hygienic action.

Multi-sensory sensor 110*h* arranged on terrace door combined with outdoor sounds—indicates possible hypothermia if not closed soon. Other scenarios are possible in other types of rooms. For example, a kitchen door opening (or a fridge door) which is followed by loud, crashing noises may be indicative of an accident (the kitchen is the most accident prone place in a modern society), especially if no further sounds or other sensor inputs are detected/received.

The audio sensor element may also be configured to recognize/identify special phrases such as "HELP" which enables a care taker to alarm a service provider.

As can be seen from the placement of the multi-sensory sensor 110*e* compared with the placement of the multi-sensory sensors 110*f* and 110*g* in FIG. 1, the multi-sensory sensor arrangement may be configured as a compromise between the necessity of control/monitoring and the personal integrity of a user or inhabitant. Such decisions on how to arrange a multi-sensory sensor 110 can be taken by the person installing the system based on the needs of the inhabitant.

FIGS. 3 and 4 show a schematic respective view of the general structure of a multi-sensory sensor system 200 according to two embodiments. The multi-sensory sensor system 200 can be described as comprising a multi-sensory sensor side and a server side. At the multi-sensory sensor side of the multi-sensory sensor system 200, a human behavioural action 116 is indirectly detected by detecting one or more basic movement(s) 114 and detecting one or more audio 113 by using at least one multi-sensory sensor 110. The multi-sensory sensor 110 is adapted for attachment to a movable structure 112 in a building. The first sensor element 330 is configured to detect a predetermined basic movement 114 of the movable structure 112, to which the multi-sensory sensor 110 is attached. To enable this detection, the first sensor element 330 may be configured to store a definition of a movement pattern for the basic movement 114 to be detected. The first sensor element 330 transmits a detection signal 118 upon detection of the basic movement 114 of the movable structure 112.

The second sensor element 335 is configured to detect a predetermined audio 113 nearby the movable structure 112, to which the multi-sensory sensor 110 is attached. To enable this detection, the second sensor element 335 may be configured to store a definition of a sound temple for the audio 113 to be detected. The second sensor element 335 transmits a detection signal 118 upon detection of the audio 113.

In one embodiment, as shown in FIG. 3, the detection signals 118 from the multi-sensory sensor 110 are received by the server side of the sensor system 200 and handled by the external controller 410. The system server 120 is configured to define an activity pattern 124, where the activity pattern is based on the two detection signals 118 from the multi-sensory sensor 110. The system server 120 is further configured to define an executable function 126 be taken based on the identified human behavioural action 116 (activity pattern 124). The activity pattern 124 and the executable function 126 are then mapped together in the server database 122, as seen at 128.

In another embodiment, as shown in FIG. 4, the detection signals 118 from the multi-sensory sensor 110 are handled by the internal controller 310 at the sensor side of the sensor system 200. The multi-sensory sensor 110 is configured to define an activity pattern 124, where the activity pattern is based on two detection signals 118 from the multi-sensory sensor 110. The two detection signals 118 are combined to indirectly identify a human behavioural action, The multi-sensory sensor 110 is further configured to determine an executable function 126 to be taken based on the identified human behavioural action 116 (activity pattern 124).

In both cases (i.e. internal controller 310 in the sensor or an external controller 410), the controller is configured to cause the executable function 126 to be executed. In the case with the internal controller 310, it causes execution of the function 126 by sending the aforementioned action detection signal 127 to the server side of the sensor system 200. The actual execution of the function 126 is then taken care of by the system server 120, by other appropriate equipment at the server side, or by remote equipment under control from the server side.

Figure 5:
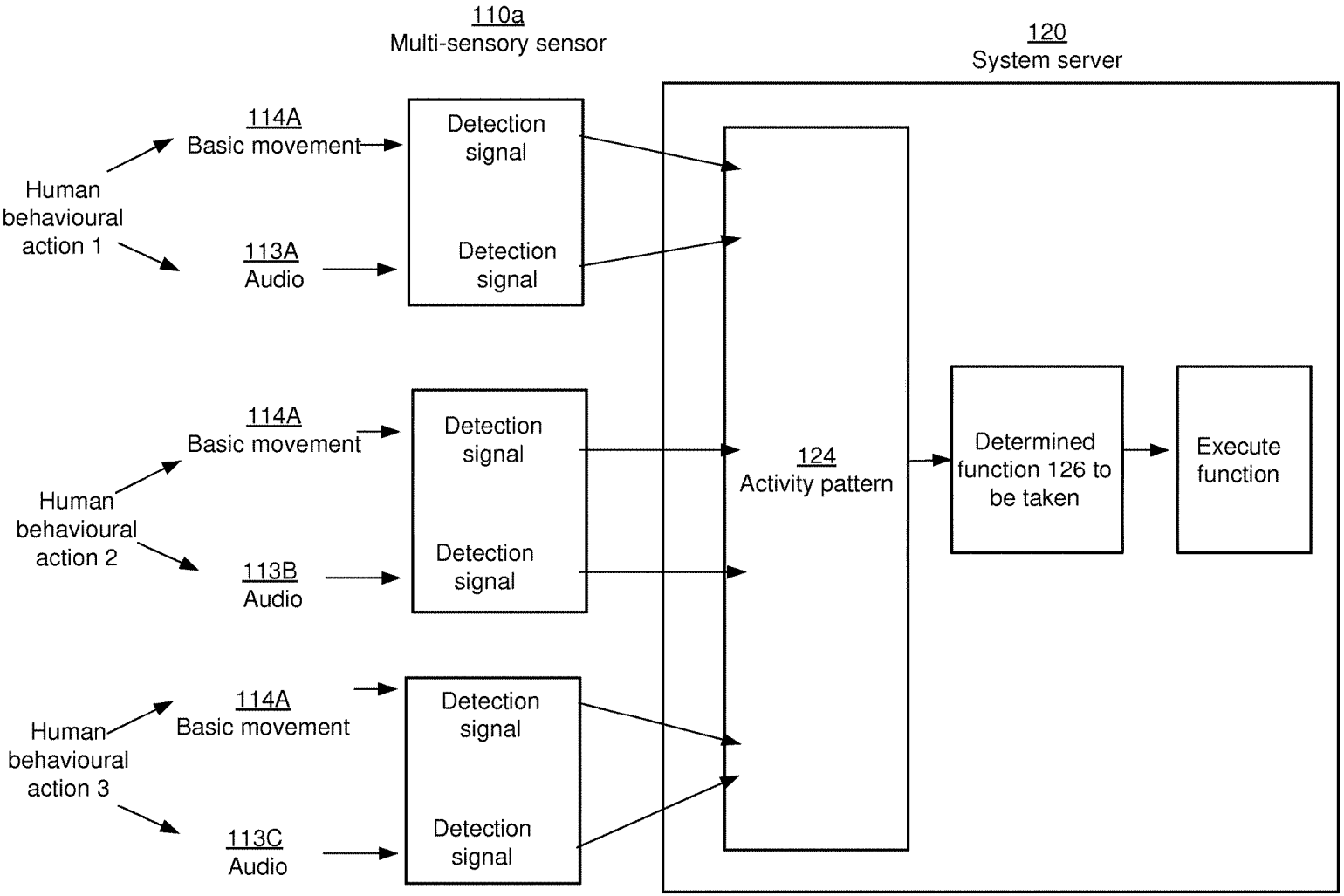
FIG. 5 shows an example of the general structure of a sensor according to one embodiment.

In one embodiment, one single multi-sensory sensor 110 may detect different human behavioural actions, as shown in FIG. 5. For example, a first human behavioural action may be characterized by a basic movement 114A and an audio 113A. The multi-sensory sensor 110 receives the two detection signals and by combining the detection signals the human behavioural action can be indirectly identified. If a second human behavioural action occurs, this might be characterized by the same movement 114A but another audio 113B. Again, the multi-sensory sensor 110 receives the two detection signals and combines them to indirectly identify the action. The audio sensor element 335 can detect a plurality of different audio 113.

FIGS. 6 and 7 exemplify data structures which may be used by the controller 310, 410. The controller 310, 410 may be configured to determine activity patterns 124 based on received detection signals 118 from the multi-sensory sensor 110 to determine an appropriate function 126 to execute. An activity pattern 124 may be based on detection signals 118 from at least the first sensor element 330 and the second sensor element 335 in the multi-sensory sensor 110, wherein the combination of detection signals 118 constitutes an activity pattern 124.

The controller 310, 410 may also be configured to combine detection signals 118 from two or more multi-sensory sensors 110 to determine an appropriate function 126 to execute, wherein the combination of detection signals 118 constitutes an activity pattern 124. Hence, an activity pattern 124 may be based on at least two detections signals 118 from one or more multi-sensory sensors 110. There may be a one-to-one relation, a one-to-many relation or a many-to-one relation between activity pattern 124 and function 126, as is apparent from the present description and FIGS. 5-7.

For example, if a detection signal 118 from a toilet door multi-sensory sensor 110*e* is received shortly after a detection signal 118 is received from a flush lever multi-sensory sensor 110*f*, this may indicate that a person has had a successful toilet visit. Thus, an activity pattern may be defined as the receipt of the detection signal from the flush lever multi-sensory sensor 110*f* followed by the receipt of the detection signal from the toilet door multi-sensory sensor 110*e*, preferably within a certain timing threshold to enhance the likelihood that this combined activity pattern 124 is correctly interpreted as the result of a successful toilet visit action 116. An appropriate function 126 to execute may be a log file entry in a monitoring system run by a care giver service.

Another example is that a series of received detection signals form a refrigerator multi-sensory sensor 110*c* and a cupboard sensor (not shown) indicates an active food preparation or an action 116 indicating confusion if repeated too many times.

In one embodiment, the system server 120 may thus be configured to determine an appropriate function based on a timing of a received detection signal, of a series of received detection signals, of a combination of detection signals and/or a series of a combination of detection signals, wherein the timing (referred to as Timing in FIG. 6) is part of the activity pattern 124. The timing may be an absolute time range (e.g. between certain times of day) and/or a relative time range (e.g. the second detection signal is received within a threshold time from the first detection signal). For example, if no detection signal is received for a prolonged time during a time of day at which an inhabitant of the house 100 would be assumed to be active, this may indicate that the inhabitant is incapacitated in some manner and that an appropriate function 126 is required such that alerting a relative, an assistance service, an emergency service, a care taking service, a medical care service or a rescue service or any combinations thereof. Other examples of patterns are for example repeated reception or reception of a number of detection signals from a toilet flush multi-sensory sensor 110*f* which indicates repeated flushing which may indicate that something is wrong. The inhabitant may be physically sick, the inhabitant may suffer from dementia or the toilet may be out of order. Another example of a combination pattern is alternating reception of detection signals from a refrigerator multi-sensory sensor 110*c* and a toilet multi-sensory sensor 110*e* or 110*f* which also may indicate that the inhabitant is experiencing problems, either physically or mentally. Again, an appropriate function may involve alerting a relative, an assistance service, an emergency service, a care taking service, a medical care service or a rescue service, or any combinations thereof.

The combination of a bathroom door opening and special phrases may also be indicative of a health status and may be used to inform an appropriate care giver.

In one embodiment, the system server 120 may also be configured to determine a severity of an activity pattern 124 and prioritise which functions should be taken based on the priority. For example, should a signal be received from the refrigerator multi-sensory sensor 110*c* indicating that the refrigerator 110*c* is opened, and the detection signal 118 is not followed by a further detection signal 118 from the refrigerator multi-sensory sensor 110*c* within a time period, indicating that the refrigerator is not closed, while also receiving a detection signal 118 from the shower door multi-sensory sensor 110*g* and the detection signal 118 is not followed by a detection signal from the toilet door multi-sensory sensor 110*e* within a time period, probably indicating a fall on the slippery floor, the latter action 116 has more severe consequences and should be treated as a higher priority action. The associated function 126 to issue an alarm to an emergency service would therefore be executed before the action 116 associated with a not closed refrigerator—to alert a care taking service for sending someone or making a call to the house to make sure that the refrigerator door is closed.

It should be noted that even though the description herein is centred on a sensor system being installed in a house it should be noted that similar systems may also be arranged in other types of buildings or environments.

In one embodiment the multi-sensory sensor 110 is configured to delete any sound(s) (temporarily) recorded as it has been analyzed. As the sensor only detects phrases and does not (necessarily) record (as in stores) the sounds, there is no threat to a person's integrity. The sound detector does not work as a sound recording device, only for detecting specific sounds.

To detect such complex scenarios as have been described above a camera has previously been required. Video surveillance is however both expensive and intrusive. The video stream needs to be analyzed, either by an operator or by an intelligent computer. The analysis can thus not be achieved (cost efficiently) in the sensor itself, but has to be transmitted to a server, thereby risking to be intercepted or otherwise misused.

Figure 8:
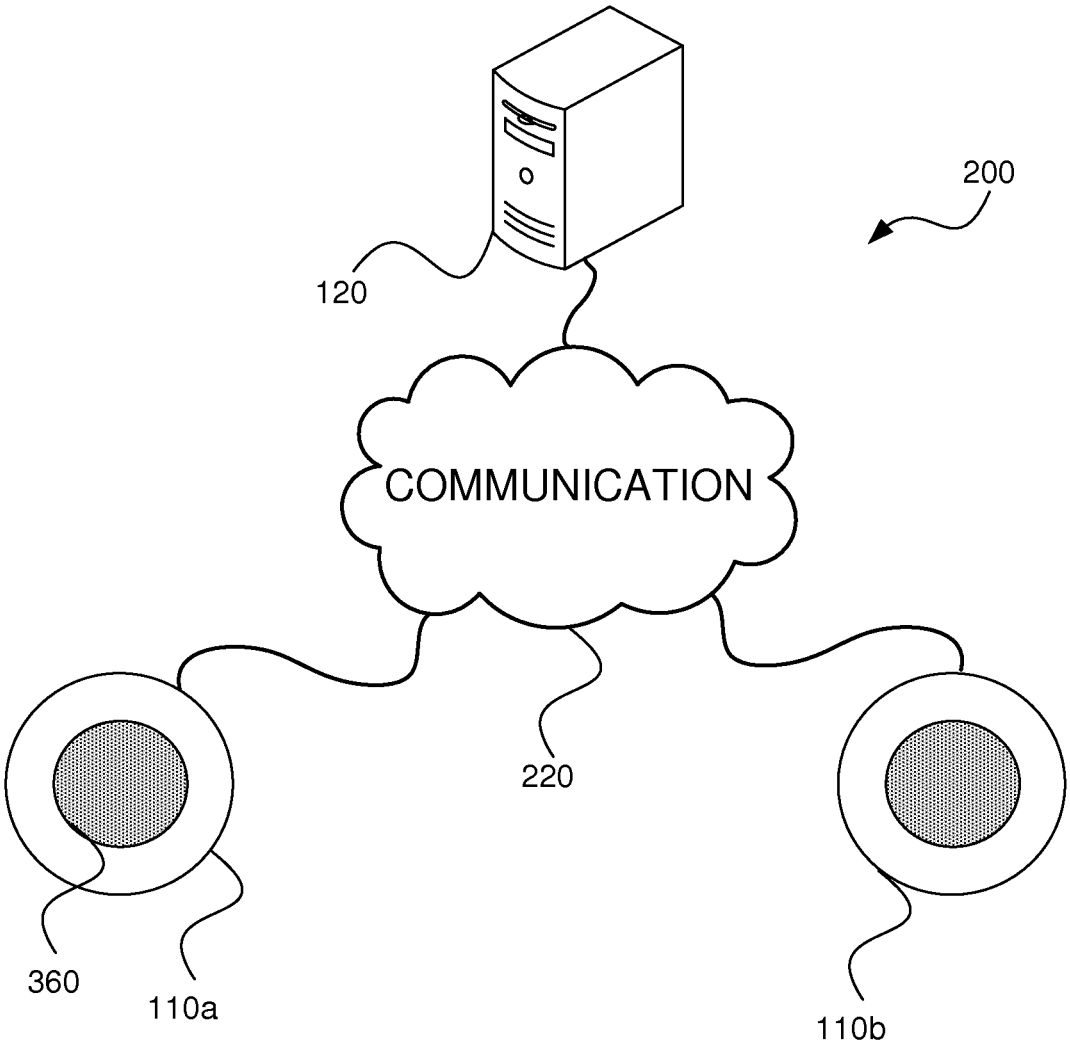
FIG. 8 shows a schematic view of the general structure of a sensor system according to one embodiment.

FIG. 8 shows an example of a sensor system 200. In the example embodiment of the sensor system 200 the sensor system 200 comprises at least one system server 120 being connected to two multi-sensory sensors 110*a* and 110*b* through a communication interface 220. The system server 120 is arranged to receive detection signals from the multi-sensory sensors 110 over the communication interface (which is comprised by the sensors' communication interface 320 and the system server's communication interface 420 as shown in and described in relation to FIGS. 9 and 10) and to determine an appropriate function to be executed and execute the function possibly by contacting a remote service provider such as a care taker service or emergency service. The function 126 may pertain to assistance, attendance, care taking, medical care, emergency service or rescue of a human user.

FIG. 9 shows a schematic overview of a multi-sensory sensor or sensing unit 110. The multi-sensory sensor 110 comprises a movement sensor element 330 and an audio sensor element 335. In one embodiment the movement sensor element 330 is an accelerometer-based movement sensor element 330. The movement sensor element 330 thus contains an accelerometer and associated movement detection circuitry.

The multi-sensory sensor 110 further comprises a controller 310, which may be implemented as one or more processors (CPU) or programmable logic circuits (PLC), which is connected to or comprises a memory 340. The memory may be implemented using any commonly known technology for computer-readable memories such as ROM, RAM, SRAM, DRAM, FLASH, DDR, SDRAM or some other memory technology. The memory 340 may be configured to store a movement pattern for a basic movement to be detected. The multi-sensory sensor 110 also comprises a communication interface 320. The communication interface may be a wireless radio frequency interface such as a Bluetooth™ or a WiFi (IEEE802.11b standard) link, or a mobile telecommunications network interface compliant with, for instance, LTE, UMTS or GSM. The communication interface 320 may also be a wired interface.

In one embodiment the controller 310 is configured to receive a detection signal 118 from the movement sensor element 330 and to transmit a motion detected signal 118 to the server via the communication interface 320.

In one embodiment, the controller 310 is configured to receive a movement signal from the movement sensor element 330 and to compare the movement signal to the movement pattern stored in the memory 340. If the movement signal matches the movement pattern, the basic movement 114 is detected. In response thereto, the controller 310 is configured to activate the communication interface 320 and transmit a detection signal 118. The controller 310 may also be configured to activate the audio sensor element 335 in response to receiving the movement from the movement sensor element 330 and also receive audio input from the audio sensor element and compare this before transmitting the detection signal.

As has been disclosed above, the multi-sensory sensor 110 may be arranged to analyze the sensed audio 113 by the internal controller 310 or by transmitting the sensed audio 113 or a processed version of the sensed audio 113 as a detector signal 118 to the server 120 for external analysis by for example the controller 410 of the server 120. The same applies to the movement sensed by the movement sensor element 330.

The multi-sensory sensor 110 may also be arranged with for example a position determining sensor, such as a global positioning system (GPS) device. Such a device may be in addition to or as an alternative to either the movement sensor element 330 or the audio sensor element 335.

The multi-sensory sensor 110 may be mounted on a cane or walking stick for determining a current position of the user.

The multi-sensory sensor 110 may be powered by a power supply 350, such as a battery, a solar cell or other power supply. The power supply 50 may also be movement activated harbouring the needed power from the actual movements that the multi-sensory sensor 110 is subjected to.

As shown in FIG. 9, the multi-sensory sensor 110 may be arranged with a user interface 360 which may be formed by a button that can be pressed to initiate an alarm sequence.

In one specific and more advanced alternative the multi-sensory sensor 110 is arranged to detect a basic movement pattern that the multi-sensory sensor 110 will later be used to detect. The sensor multi-sensory 110 is configured to register one or more movements of the movable structure 112 to which it is attached, wherein such movement pattern represents the basic movement 114 to be detected. In this embodiment, the controller has a configuration mode in which it is adapted to generate a definition of the detected movement pattern and store the generated definition of the movement pattern in the local memory 340, thus creating a predetermined basic movement to be detected. The registering of the movement pattern may be accomplished by recording a number of points along a performed trajectory and vectorizing these points. The registering of the movement pattern may be performed upon an initial start-up of the multi-sensory sensor 110 or upon prompting by the system server 120. Such a sensor brings the benefit that the sensor is highly flexible in that it can be configured to detect any movement, little or small, complex or simple.

FIG. 10 shows a schematic view of the general structure of a system server 120. The system server may be implemented as a smart phone, a computer, a tablet computer or a dedicated device.

The system server 120 comprises a controller 410. The controller 410 may be implemented using instructions that enable hardware functionality, for example, by using executable computer program instructions in a general-purpose or special-purpose processor that may be stored on a computer readable storage medium (disk, memory etc) 440 to be executed by such a processor. The controller 410 is configured to read instructions from the memory 440 and execute these instructions to control the operation of the system server 120.

The system server 120 may be arranged to store an identifier for each multi-sensory sensor 110 in the system, so that the system server may determine which sensor that a signal is received from and determine which action should be taken in response thereto.

The memory may be implemented using any commonly known technology for computer-readable memories such as ROM, RAM, SRAM, DRAM, CMOS, FLASH, DDR, SDRAM or some other memory technology. The system server 120 further comprises one or more applications 450. The applications are set of instructions that when executed by the controller 410 control the operation of the system server 120. The applications 450 may be stored on the memory 440.

The system server 120 may further comprise a user interface 430, which may comprise a display (not shown) and a number of keys (not shown) or other input devices.

The system server 120 further comprises a communication interface 420, such as a radio frequency interface 420, which is adapted to allow the system server 120 to communicate with at least one sensor 110 and also other devices, such as a remote service provider server through a radio frequency band through the use of different radio frequency technologies for mobile telecommunications. Examples of such technologies are W-CDMA, GSM, UTRAN, LTE, and NMT to name a few. The communication interface 420 may be arranged to communicate with the multi-sensory sensors 110 using one technology (for example, Bluetooth or WiFi or even a wired interface) and with other devices such as a remote service provider server through for example LTE or through an internet protocol.

References to 'computer-readable storage medium', 'computer program product', 'tangibly embodied computer program' etc. or a 'controller', 'computer', 'processor' etc. should be understood to encompass not only computers having different architectures such as single/multi-processor architectures and sequential (Von Neumann)/parallel architectures but also specialized circuits such as field-programmable gate arrays (FPGA), application specific circuits (ASIC), signal processing devices and other devices. References to computer program, instructions, code etc. should be understood to encompass software for a programmable processor or firmware such as, for example, the programmable content of a hardware device whether instructions for a processor, or configuration settings for a fixed-function device, gate array or programmable logic device etc.

Figure 11:
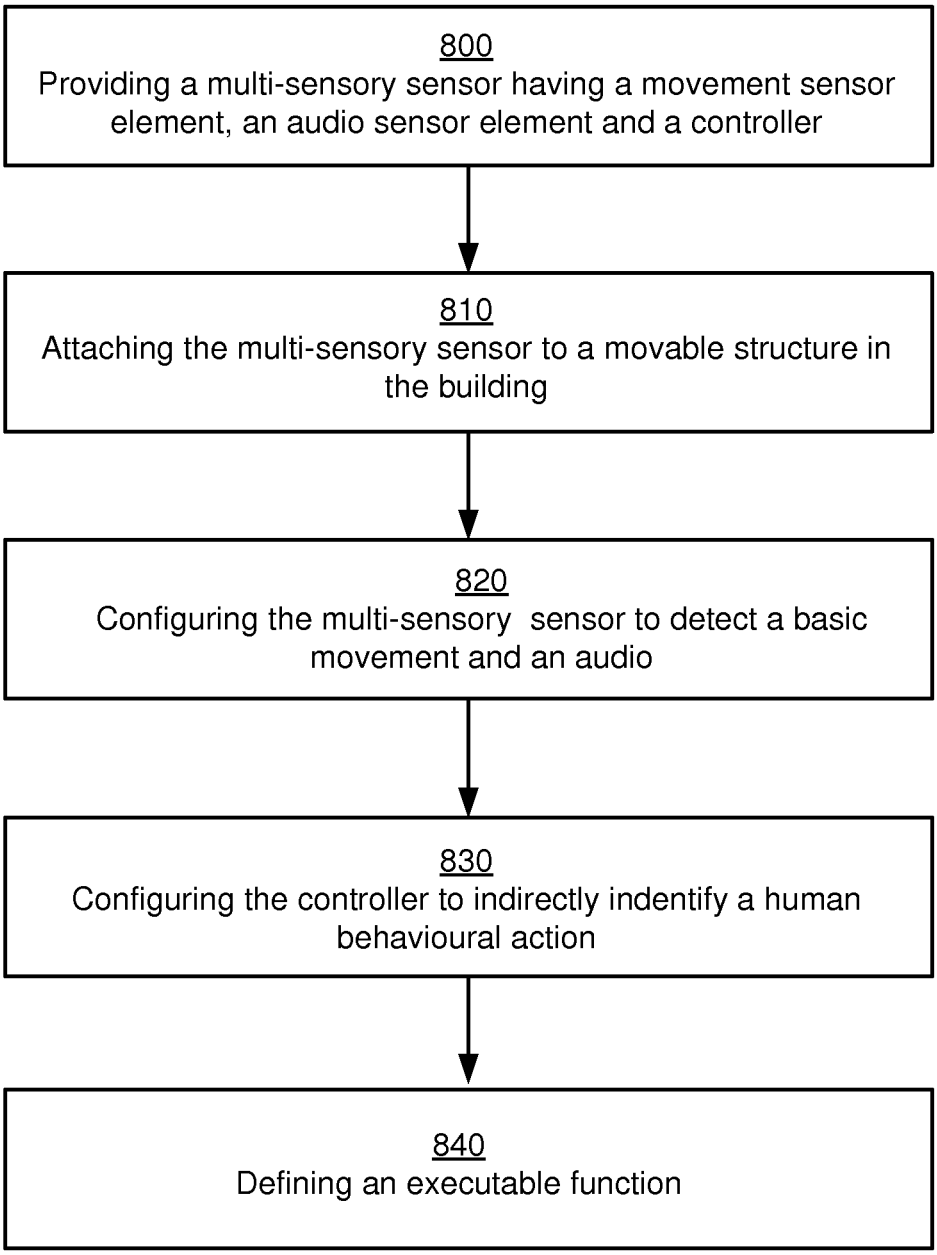
FIG. 11 shows a flowchart of a method according to one embodiment.

FIG. 11 shows a flowchart of a method of configuring a multi-sensory sensor 110 for behavioural monitoring of a user in a building according to one embodiment. The method involves providing, 800, a multi-sensory sensor 110. The multi-sensory sensor 110 comprises a first and a second sensor element 330, 335, wherein the first sensor element is a movement sensor element 330 and the second sensor element is an audio sensor element 335. The multi-sensory sensor 110 is operatively associated with a controller 310, 410. The multi-sensory sensor 110 is attached, 810, to a movable structure 112 in a building. The multi-sensory sensor 110 is configured, 820, to detect a basic movement 114 and an audio 113. The basic movement 114 and the audio 113 are indicative of a human behavioural action 116 in the building.

The controller being operatively associated with the multi-sensory sensor is configured, 330, to indirectly identify a human behavioural action 116 based on a combination of detection signals 118 from the multi-sensory sensor 110. The controller 310, 410 may also define an activity pattern 124, where the activity pattern 124 is based on detection signals 118 from the multi-sensory sensor 110, and an executable function 126.

The controller 310, 410 is further configured to define, 840, an appropriate executable function 126 based on the identifiable action. The executable function may pertain to assistance, attendance, care taking, medical care, emergency service or rescue of a human user in the building.

Figure 12:
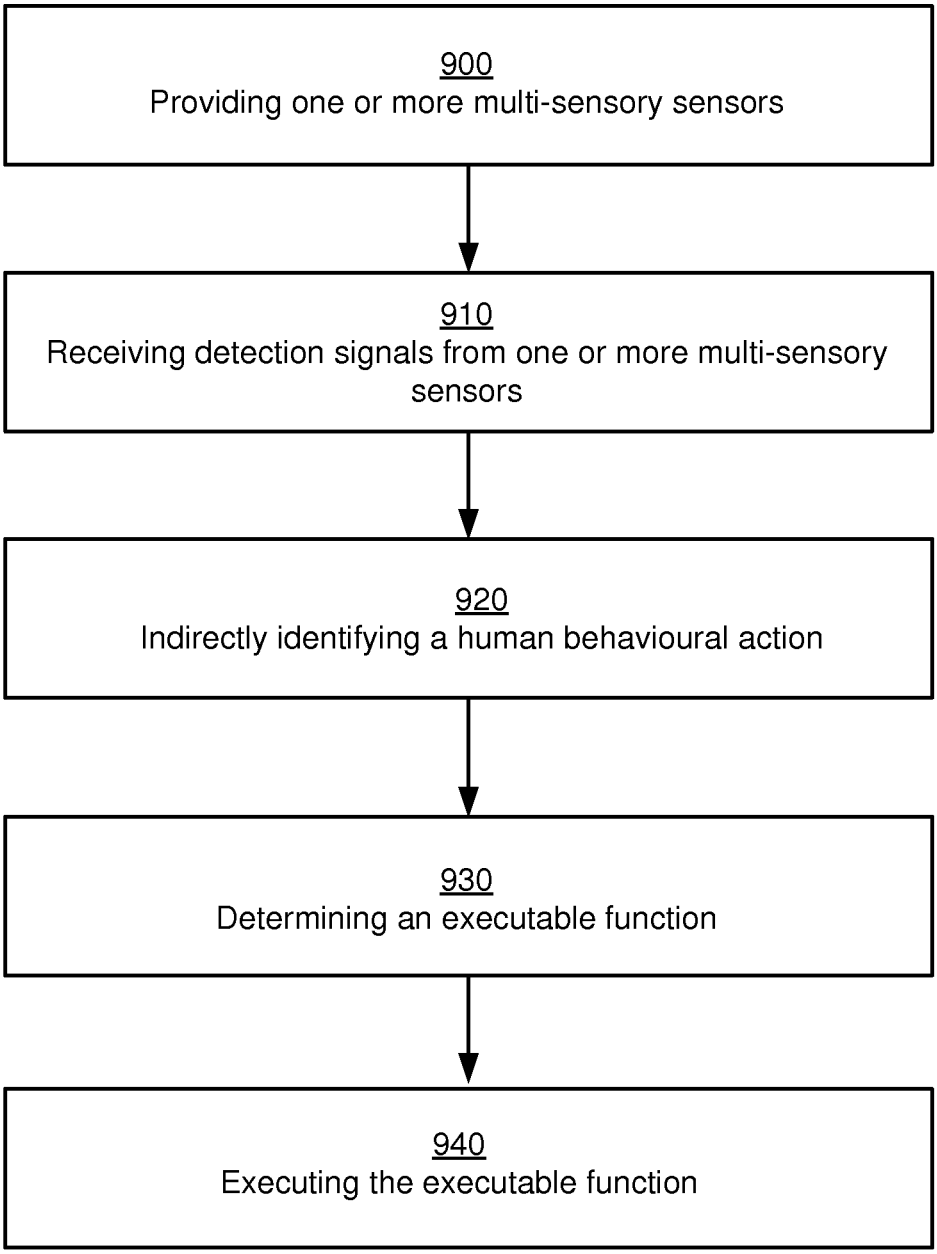
FIG. 12 shows a flowchart of a method according to one embodiment.

FIG. 12 shows a flowchart of a method of behavioural monitoring of a user in a building using a sensor system 200 according to one embodiment. One or more multi-sensory sensors 110 are provided, 900. The controller 310, 410 receives, 910, detection signals 118 from one or more multi-sensory sensors 110. Based on a combination of said detection signals 118, the controller indirectly identifies, 920, a human behavioural action 116. An appropriate executable function 126 is determined, 930, based on the identified action.

In one embodiment, the controller 310, 410 or system server 120 may determine a activity pattern 124 among a plurality of activity patterns 124. Based on the determined activity pattern 124, the appropriate function may be determined among a plurality of executable functions.

The determined appropriate function 126 is executed, 940, by or under the control of the system server 120.

One benefit of the teachings herein is that an advanced sensor system is enabled using simple sensors that are of the same type—or at least taken from a small group of different subtypes of sensors (the subtypes may be relate to different sizes or different sensitivities)—which are easy to install or mount and, when combined in a clever manner, combine to provide advanced monitoring through indirect (and direct) detection of actions.

The invention has mainly been described above with reference to a few embodiments. However, as is readily appreciated by a person skilled in the art, other embodiments than the ones disclosed above are equally possible within the scope of the invention, as defined by the appended patent claims.

In one such alternative embodiment, a multi-sensory sensor is provided which comprises at least a first and a second sensor element, where said multi-sensory sensor is operatively connected to a controller. The controller is configured to receive input from said first sensor element, receive input from said second sensor element, determine a function to be taken based on a combination of said input from said first sensor element and said input from said second sensor element and cause said function to be taken to be executed, wherein said combination of said input from said first sensor element and said input from said second sensor element indirectly identifies an action, which action is associated with the function to be taken.

In one such alternative embodiment, the first sensor element is a movement sensor element for sensing a movement and said second sensor element is an audio sensor element for sensing audio.

In one such alternative embodiment, the multi-sensory sensor comprises said controller and wherein said controller is configured to cause said function to be taken to be executed by transmitting a detection signal to a server.

In one such alternative embodiment, a server comprises said controller and wherein said multi-sensory sensor is configured to transmit said input from said second sensor element to said server.

In one such alternative embodiment, the multi-sensory sensor is configured to also transmit said input from said first sensor element to said server.

In one such alternative embodiment, the multi-sensory sensor is configured to activate said audio sensor element as said movement sensor element senses a movement.

In one such alternative embodiment, the multi-sensory sensor further comprises a position determining sensor such as a global positioning service device (GPS).

In one such alternative embodiment, a sensor system comprising at least one multi-sensory sensor and a system server, wherein said at least one multi-sensory sensor is arranged to transmit a detection signal or sensor input to said server, wherein said server is arranged to cause execution of a function to be taken.

In one such alternative embodiment, the system server is configured to combine sensor signals from different multi-sensory sensors to determine the function to be taken, wherein the combination constitutes a pattern.

What is claimed is:

1. A multi-sensory sensor comprising at least a first and a second sensor element, wherein said first sensor element is a movement sensor element for sensing a movement and said second sensor element is an audio sensor element for sensing audio, said multi-sensory sensor being adapted for attachment to any one of different types of movable structures in a building, said multi-sensory sensor comprising an internal controller being configured to receive input from said first sensor element, said input being indicative of a movement of said movable structure;

receive input from said second sensor element;

indirectly identify, based on a combination of said input from said first sensor element and said input from said second sensor element, a human behavioural action in said building among more than one possible action, wherein the identified action is an action by an inhabitant in said building, selected from the group consisting of:

an action indicating that the inhabitant is experiencing problems either physically or mentally;

an action indicating that the inhabitant is incapacitated in some manner;

an action indicating that something is wrong with the inhabitant;

an action indicating the health status of the inhabitant;

an action indicating that the inhabitant is eating;

an action indicating that the inhabitant is performing a hygienic action; and an action indicating that the inhabitant is taking her medication;

determine, based on the identified action, a function to be taken; and cause said function to be executed, wherein said multi-sensory sensor has a local memory and a configuration mode in which the controller is configurable to store a movement pattern for a basic movement to be detected and to store a sound template for an audio by:

detecting a sound template and a movement pattern of the movable structure to which said multi-sensory sensor is attached;

generating a definition of the detected sound template and movement pattern; and storing the generated definitions in the local memory.

2. The multi-sensory sensor according to claim 1, wherein said controller is configured to cause said function to be taken to be executed by transmitting an action detection signal to a server.

3. The multi-sensory sensor according to claim 1, wherein the multi-sensory sensor is configured to activate said audio sensor element as said movement sensor element senses a movement.

4. The multi-sensory sensor according to claim 1, wherein the movable structure is selected from: a door, a window, a lever, remote control, a pill organiser, a drawer, a hatch.

5. The multi-sensory sensor according to claim 1, wherein the function pertains to assistance, attendance, care taking, medical care, emergency service or rescue of a human user in said building.

6. A sensor system comprising at least one multi-sensory sensor according to claim 1 and a system server, wherein said at least one multi-sensory sensor is arranged to transmit a detection signal or sensor input to said server, wherein said server is arranged to cause execution of said function to be taken.

7. The sensor system according to claim 6, wherein the system service is configured to combine sensor signals from different multi-sensory sensors to determine the function to be taken, wherein the combination constitutes a pattern.

8. A method of configuring a multi-sensory sensor for behavioural monitoring of a user in a building, the method comprising:

providing a multi-sensory sensor having a first sensor element in the form of a movement sensor element and a second sensor element in the form of an audio sensor element, the multi-sensory sensor comprising an internal controller;

attaching the multi-sensory sensor to any one of different types of movable structures in said building, said different types of movable structures including a first type of movable structure and a second type of movable structure;

configuring said first sensor element to detect a first basic movement and said second sensor element to sense a first audio when the multi-sensory sensor is attached to the first type of movable structure, said first basic movement and the first audio being indicative of a first human behavioural action in said building among more than one possible action;

configuring said first sensor element to detect a second basic movement and said second sensor element to sense a second audio when the multi-sensory sensor is attached to the second type of movable structure, said second basic movement and the second audio being indicative of a second human behavioural action in said building among more than one possible action;

configuring the controller to indirectly identify the first human behavioural action or the second human behavioural action based on a combination of detection signals from the multi-sensory sensor; and defining a first appropriate executable function or a second appropriate executable function based on the identified first human behavioural action or second human behavioural action, wherein the first appropriate executable function or the second appropriate executable function pertains to assistance, attendance, care taking, medical care, emergency service or rescue of a human user in said building.

9. A method of behavioural monitoring of a user in a building, the method comprising:

providing one or more multi-sensory sensors having been configured according to the method in claim 8;

receiving detection signals from said one or more multi-sensory sensors;

indirectly identifying a human behavioural action based on a combination of said detection signals;

determining an appropriate executable function based on the identified action; and executing the determined appropriate function.

10. A sensor system comprising at least two multi-sensory sensors and a system server, wherein each multi-sensory sensor comprises at least a first and a second sensor element, wherein at least one multi-sensory sensor is adapted for attachment to any one of different types of movable structures in a building and wherein at least one multi-sensor sensor is adapted for attachment to another type of movable structure in a building, wherein each multi-sensory is operatively connected to a controller being configured to:

receive sensor input from said first sensor element, said input being indicative of a movement of said movable structure;

receive sensor input from said second sensor element;

wherein said at least two multi-sensory sensors are arranged to transmit sensor input to said server, and wherein said server is arranged to:

indirectly identify, based on a combination of said input from said first sensor element and said input from said second sensor element from the first multi-sensory sensor, a first action among more than one possible action of an inhabitant in said building, indirectly identify, based on a combination of said input from said first sensor element and said input from said second sensor element from the second multi-sensory sensor, a second action among more than one possible action of an inhabitant in said building;

determine, based on said identified actions, a function among a plurality of executable functions; and cause said function to be taken to be executed.

11. The sensor system according to claim 10, wherein said first sensor element is a movement sensor element for sensing a movement and said second sensor element is an audio sensor element for sensing audio.

12. The sensor system according to claim 11, wherein the multi-sensory sensor is configured to activate said audio sensor element as said movement sensor element senses a movement.

13. The sensor system according to claim 10, further comprising a position determining sensor such as a global positioning service device, GPS.

* * * * *